United States Patent [19]

Croll

[11] Patent Number: 4,565,376

[45] Date of Patent: Jan. 21, 1986

[54] ANIMAL SIMULATING THREE DIMENSIONAL ARCHERY TARGET AND METHOD OF MANUFACTURE

[76] Inventor: Lionel Croll, 2468 Coral St., Philadelphia, Pa. 19125

[21] Appl. No.: 717,289

[22] Filed: Mar. 28, 1985

[51] Int. Cl.[4] ..... F41J 3/00

[52] U.S. Cl. ..... 273/408; 446/369

[58] Field of Search ..... 273/408, 403, 404; 446/369–375

[56] References Cited

U.S. PATENT DOCUMENTS

| | | | |
|---|---|---|---|
| 2,516,479 | 7/1950 | Opel | 446/373 |
| 2,812,947 | 11/1957 | Fatzinger et al. | 273/404 |
| 3,163,418 | 12/1964 | Myers | 273/408 |
| 4,126,501 | 11/1978 | Croll | 273/408 X |
| 4,203,600 | 5/1980 | Brown | 273/408 X |
| 4,244,585 | 1/1981 | Croll | 273/408 |

*Primary Examiner*—Paul E. Shapiro

*Attorney, Agent, or Firm*—Robert K. Youtie

[57] ABSTRACT

An archery target wherein transversely gathered thermoplastic film is wrapped into the shape of an animal to be simulated, the wrapped shape is covered with thermoplastic sheeting heat sealed to the wrapped film, and the shape is filled with additional transversely gathered plastic film folded upon itself and inserted into the wrapped film shape.

1 Claim, 8 Drawing Figures

ANIMAL SIMULATING THREE DIMENSIONAL ARCHERY TARGET AND METHOD OF MANUFACTURE

BACKGROUND OF THE INVENTION

As is well known to those versed in the field of archery, it is often desirable to employ simulated animals as targets, say in preparation for the deer hunting season, or the like. Various animal simulating targets have been proposed in the prior art, including those listed below, of which applicant is aware:

| U.S. PAT. NO. | PATENTEE |
|---|---|
| 2,812,947 | FATZINGER ET AL. |
| 3,163,418 | MYERS |
| 4,054,288 | PERRINE, SR. |
| 4,203,600 | BROWN |

However, these prior art simulated animal targets are not entirely satisfactory, being relatively expensive to manufacture, subject to rapid wear and lacking a true simulation of arrow action in the field.

Applicant's prior U.S. Pat. Nos. 4,126,501 and 4,244,585 have been found superior in tournament usage requiring bull's-eye type disc targets, but these were not capable of animal-simulating targets.

SUMMARY OF THE INVENTION

Accordingly, it is an important object of the present invention to provide a new construction of animal simulating archery target and method of manufacture which is adapted to be fabricated substantially of plastic film material to achieve its accurate simulation of arrow action in the field, and its self-sealing effect which greatly increases useful life.

It is a further object of the present invention to provide an archery target and method of manufacture having the advantageous characteristics mentioned in the preceding paragraph, which is relatively light in weight for reduced shipping and handling costs, resistant to combustion, mold, moisture absorption and infestation, and which is substantially repairable by simple reheating of the surface.

It is a more particular object of the present invention to provide an archery target of the type described wherein plastic film is transversely gathered and shaped to simulate an animal, being heat sealed for securement in its animal simulating shape, and further provided with cover sheeting of plastic film as well as gathered and folded plastic film filling the interior of the animal shape.

Other objects of the present invention will become apparent upon reading the following specification and referring to the accompanying drawings, which form a material part of this disclosure.

The invention accordingly consists in the features of construction, combinations and arrangements of parts and method steps, which will be exemplified in the following description, and of which the scope will be indicated by the appended claims.

DESCRIPTION OF THE PREFERRED EMBODIMENTS

Figure 1:
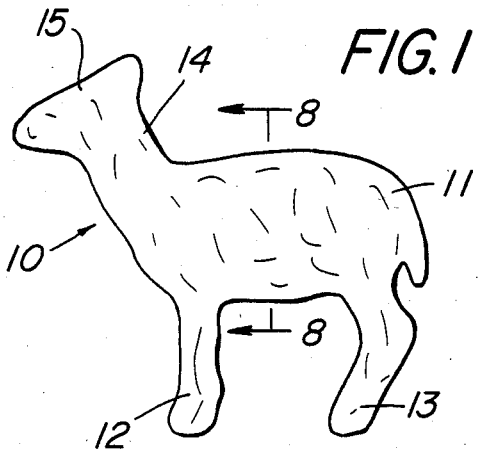
FIG. 1 is a side elevational view showing an animal simulating archery target of the present invention.

Referring now more particularly to the drawings, and specifically to FIG. 1 thereof, a completed animal simulating archery target is there generally designated 10, generally assuming the shape of a deer having a body or torso 11, legs 12 and 13, a neck 14 and head 15. The completed target may assume other animal simulating shapes, if desired, and be of any desired scale, up to full size.

Figure 2:
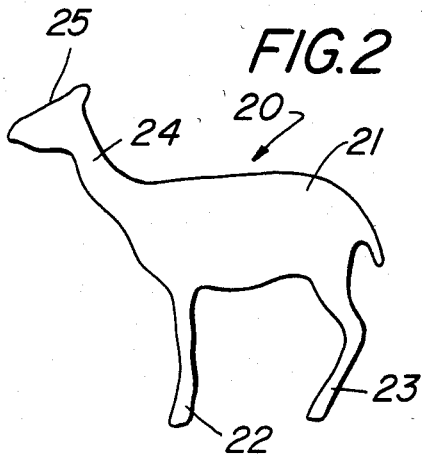
FIG. 2 is a side elevational view showing a form for use in manufacture in accordance with the instant invention.

In FIG. 2 a form is generally designated 20, for use in manufacture of the target 10. The form 20 may be hollow, solid or open framework, fabricated of any suitable material, say paperboard or other, and is of a shape similar to that of target 10 but of a proportionally smaller size. Thus, the deer simulating form 20 is of a shape similar to and size smaller than the deer simulating target 10, including a body or torso portion 21, front and rear legs 22 and 23, neck 24 and head 25.

Figure 3:
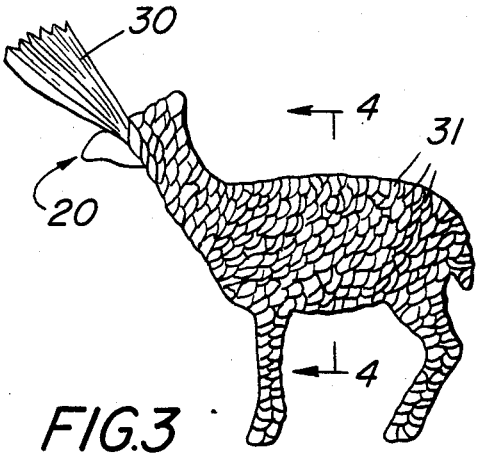
FIG. 3 is a side elevational view showing an intermediate stage of the instant method.
Figure 4:
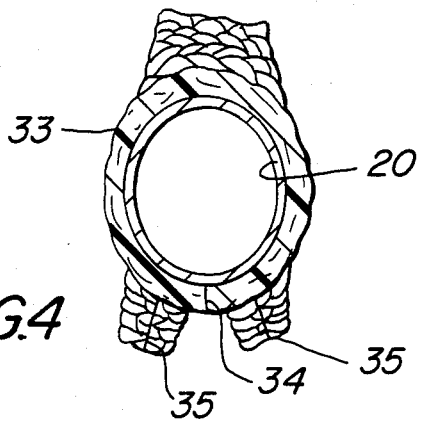
FIG. 4 is a transverse sectional view taken generally along the line 4—4 of FIG. 3 and illustrating an intermediate stage of the manufacturing method.

In the method of the instant invention an elongate sheet or web of thermoplastic film, such as low density polyethylene, is shown in FIG. 3 at 30. The web has there been transversely gathered, as by passing through a constriction, as in my prior U.S. Pat. No. 4,126,501. The transversely gathered web 30 is repeatedly wound about the form 20, as by a multiplicity of contiguous convolutions 31, to completely cover all portions of the form. As illustrated in FIG. 3, the form 20 is almost completely covered by the windings of thermosplastic web 30, except for the nose portion, which remains to be covered.

With the transversely gathered plastic web wound about and completely covering the form 20, the convolutions 31 may be tacked or heat sealed together at spaced locations sufficiently to maintain the convolutions in position wound about the form 20. With the gathered convolutions 31 of thermoplastic web or film 30 sufficiently secured together, as by heat sealing, so that the convoluted and gathered plastic film defines a form retaining wall 33 conformably surrounding the form 20, the wall may be severed, as by incisions or cuts 34 along the body and 35 along the legs. The incisions or cuts 34 and 35 are sufficient to enable the wall 33 to be opened for removal of the form 20 from the interior hollow of the wall.

The interior hollow of the wall 33 may then be filled with additional transversely gathered webs or lengths of plastic film to substantially fully occupy the interior of the wall 33.

Figure 5:
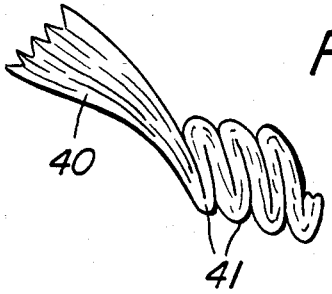
FIG. 5 is a perspective view illustrating a method step of the instant invention.
Figure 6:
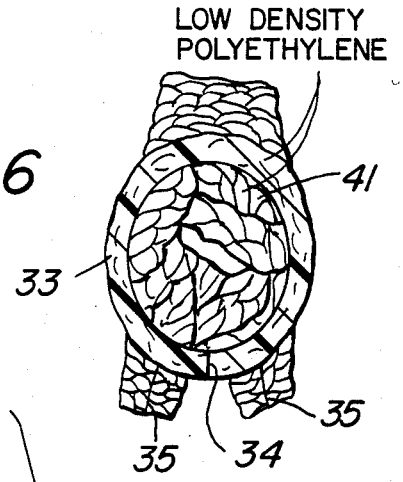
FIG. 6 is a view similar to FIG. 4 illustrating a later stage in the instant method.

More specifically, the interior plastic film or filling is shown in FIG. 5 as being formed from an elongate plastic film or web, say of low density polyethylene material, as at 40, transversely gathered, as by feeding through a constriction, and subsequently wound or folded upon itself, as at 41. This procedure effectively increases the bulk of the film 40, after which the bulked-up material 41 is inserted into the interior hollow of the wall 33, as seen in FIG. 6. This bulking procedure of FIG. 5 produces the filling material 41 which is capable of insertion into all shapes and sizes of cavities within the wall 33, while completely filling and occupying the interior of the latter, all for a purpose appearing presently.

Figure 7:
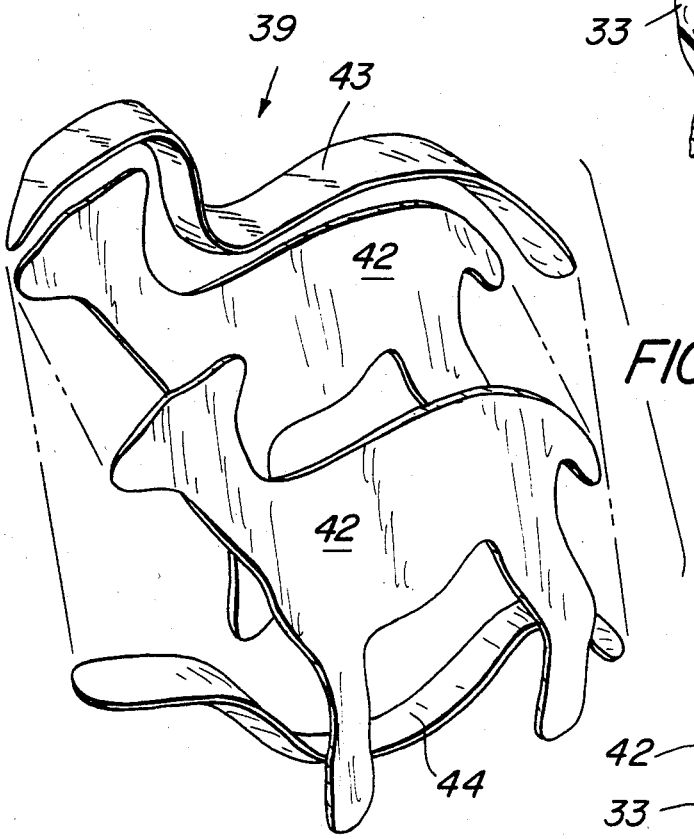
FIG. 7 is an exploded perspective view showing still a later stage of the instant method.
Figure 8:
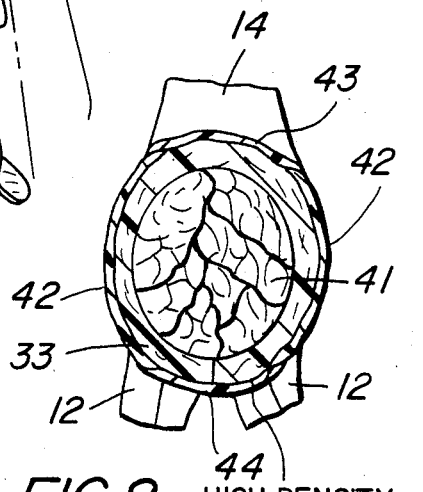
FIG. 8 is a transverse sectional view taken generally along the line 8—8 of the finished target of FIG. 1.

After filling or stuffing of the hollow wall 33 by the bulked-up film 41, there is provided cover sheeting for the exterior of the wall. Such cover sheeting is shown in FIG. 7 and there generally designated 39, which may comprise a plurality of specifically configured or patterned sheets adapted to conjointly overly and substantially completely cover the exterior of wall 33. For example, there may be a pair of side cover sheets 42 for the left and right sides of the wall 33, and additionally a pair of upper and lower cover sheets 43 and 44 for covering the top and bottom of the wall 33. It has been found advantageous to fabricate the cover sheets 42 and 43 of thermoplastic film of a higher resistance to rupture, such as high density polyethylene. With the cover sheets 42–44 laid upon the exterior of the wall 33, substantially completely covering the latter and with their adjacent marginal edges in overlying relation with each other, as seen in FIG. 8, the covering sheets may be heat sealed to each other and to the underlying surface of wall 33. This condition is shown in FIG. 8 wherein the cover sheeting 42 and 43 effectively encompasses the wall 33 defining therewith a unitary animal simulating form. If desired the exterior of the cover sheet 42 and 43 may be suitably decorated, as by animal simulating features, colors, etc.

It has been found that the relatively high density covering sheet 42–44, together with the low density transversely gathered convolutions or windings 31 of the wall 33, and the transversely gathered and wound or folded interior filling 41 combine to define an archery target which accurately simulates target action found in live animals, is highly resistant to wear, while being capable of quick and easy repair by heat sealing or patching of a ruptured area of cover sheeting. Further, the desired shape is maintained throughout a long target life by the unitizing effect of heat sealing the cover sheeting 42 to the outer surface of wall 33, and further heat sealing of the cover sheets 42–44 to each other along the marginal edges.

From the foregoing, it is seen that the present invention provides an animal simulating archery target and method of manufacture which are extremely simple in structure and method and otherwise fully accomplish their intended objects.

Although the present invention has been described in some detail by way of illustration and example for purposes of clarity of understanding, it is understood that certain changes and modifications may be made within the spirit of the invention.

What is claimed is:

1. An archery target comprising a form retaining wall fabricated of lengths of transversely gathered thermoplastic film wound to assume the desired shape, cover sheeting of thermoplastic material configured to cover the desired shape and heat sealed in position overlying said wall, said wall being hollow, and additional lengths of transversely gathered plastic film folded upon itself and occupying the hollow of said wall, said wall and additional lengths being fabricated of low density polyethylene film, said cover sheeting being fabricated of high density polyethylene film.

* * * * *